US010533742B2

(12) United States Patent
Akiyama et al.

(10) Patent No.: US 10,533,742 B2
(45) Date of Patent: Jan. 14, 2020

(54) BURNER CASE AND BURNER DEVICE PROVIDED WITH THE BURNER CASE

(71) Applicant: NORITZ CORPORATION, Hyogo (JP)

(72) Inventors: Takashi Akiyama, Kobe (JP); Ryosuke Umakoshi, Kobe (JP); Taihei Terasawa, Kobe (JP); Kenichi Sakurai, Kobe (JP); Tatsuya Karaki, Kobe (JP); Naoki Se, Kobe (JP)

(73) Assignee: NORITZ CORPORATION, Hyogo (JP)

( * ) Notice: Subject to any disclaimer, the term of this patent is extended or adjusted under 35 U.S.C. 154(b) by 500 days.

(21) Appl. No.: 15/405,017

(22) Filed: Jan. 12, 2017

(65) Prior Publication Data

US 2017/0205067 A1 Jul. 20, 2017

(30) Foreign Application Priority Data

Jan. 19, 2016 (JP) ..... 2016-007779
Oct. 25, 2016 (JP) ..... 2016-208400

(51) Int. Cl.

| | |
|---|---|
| ***F23D 14/62*** | (2006.01) |
| ***F23D 14/22*** | (2006.01) |
| ***F23D 14/10*** | (2006.01) |
| ***F23D 14/46*** | (2006.01) |
| ***F23D 14/04*** | (2006.01) |
| ***F23D 23/00*** | (2006.01) |

(52) U.S. Cl.
CPC ..... *F23D 14/22* (2013.01); *F23D 14/045* (2013.01); *F23D 14/105* (2013.01); *F23D 14/46* (2013.01); *F23D 23/00* (2013.01); *F23D 2203/00* (2013.01)

(58) Field of Classification Search
CPC ..... F23D 14/22; F23D 14/105; F23D 14/045
USPC ..... 431/354, 202; 126/99 R, 116 R, 116 A, 126/116 B, 104 R
See application file for complete search history.

(56) References Cited

FOREIGN PATENT DOCUMENTS

JP 2013-242080 A 12/2013

*Primary Examiner* — Vivek K Shirsat
(74) *Attorney, Agent, or Firm* — Studebaker & Brackett PC

(57) ABSTRACT

A burner case and a burner device provided with the burner case are disclosed. A cover for closing an opening of a case body of the burner case is attached to the case body by a first caulking portion and a second caulking portion. A first caulking direction and a second caulking direction intersect with each other, the first caulking direction is a direction in which a first attachment piece and a first facing portion, those constituting the first caulking portion, face each other and are caulked, the second caulking direction is a direction in which a second attachment piece and a second facing portion, those constituting the second caulking portion, face each other and are caulked. Thus, the case body and the cover are not required to be screwed or the number of the screws is reduced, and leakage of gas from the burner case to outside is prevented.

9 Claims, 5 Drawing Sheets

BURNER CASE AND BURNER DEVICE PROVIDED WITH THE BURNER CASE

BACKGROUND OF THE INVENTION

Field of the invention

The present invention relates to a technology relating to a burner device to be used as a constitutional element of a water heating apparatus.

Description of the Related Art

One embodiment of a burner device is disclosed in Patent Literature 1.

In the burner device, a plurality of burner bodies, referred to as a burner head or a combustion tube, are housed in a burner case and the heating power is controllable. The burner case is a substantial cuboid which is made of a metal plate and has a top opening, and a heat exchanger is provided on the burner case. When the burner body is driven for combustion, combustion gas passes through the top opening and flows toward the heat exchanger. The burner case is constituted by a case body and a cover, the case body having a rear opening in addition to the top opening, the cover closing the rear opening. The rear opening is used for incorporating the burner body into the case body.

In such a burner device, it is necessary to prevent gas in the burner case from leaking outside. Conventionally, a flange portion is provided along the rear opening of the case body, a sealing packing is interposed between the flange portion and the cover, and the cover is screwed at plural points to the flange portion.

However, in the related art, the cost for a sealing packing is required in addition to the cost for screwing members, thereby increasing the material cost of the burner case. In addition, a screwing operation is complicated and its productivity is not so high. Thus, there is such a disadvantage that the production cost of the burner case and also the production cost of the burner device increase.

CITATION LIST

Patent Literature 1: Japanese Unexamined Patent Application Publication No. 2013-242080, referring to FIG. 1 to FIG. 4.

SUMMARY OF THE INVENTION

An object of the present invention is to provide a burner case capable of solving or reducing the above-mentioned disadvantage and to provide a burner device having the burner case.

In order to solve the above-mentioned problems, the present invention proposes the following technical means.

A burner case proposed in the first aspect of the present invention includes a case body having an opening and housing a burner body, a cover configured to be attached to the case body and to close the opening, a first attachment piece and a second attachment piece which are provided for the case body along a periphery of the opening, a first facing portion provided for the cover and configured to face the first attachment piece in a predetermined first direction, a second facing portion provided for the cover and configured to face the second attachment piece in a second direction intersecting with the first direction, a first caulking portion configured in such a manner that a first non-extending base portion is interposed between a first extending portion and a first extending base portion in the first direction, the first extending base portion being one of the first attachment piece and the first facing portion, the first extending base portion being connected with the first extending portion with an angle, the other of the first attachment piece and the first facing portion being the first non-extending base portion, and a second caulking portion configured in such a manner that a second non-extending base portion is interposed between a second extending portion and a second extending base portion in the second direction, the second extending base portion being one of the second attachment piece and the second facing portion, the second extending base portion being connected with the second extending portion with an angle, the other of the second attachment piece and the second facing portion being the second non-extending base portion.

Preferably, the case body and the cover are respectively made of a metal plate.

Preferably, either the first direction or the second direction is an opening direction of the opening.

Preferably, the case body has a bottom wall portion, a pair of side wall portions provided on right and left, and a rear opening, the side wall portions rising upward from both end portions of the bottom wall portion in a width direction, the rear opening being surrounded with rear end edge portions of the side wall portions and a rear end edge portion of the bottom wall portion, the rear opening constituting the opening. The first and the second attachment pieces are provided for the rear end edge portions of the side wall portions and the rear end edge portion of the bottom wall portion. The cover is in a shape of a plate rising in a vertical height direction, the first facing portion is provided at both end portions of the cover in a width direction and the second facing portion is provided at a lower end portion of the cover.

Preferably, each rear end edge portion of the side wall portions is provided with a flange portion of which front and back surfaces are directed in a back-and-forth direction of the case body and extend in a vertical height direction, the flange portion being the first attachment piece. The rear end edge portion of the bottom wall portion is configured in such a manner that the front and the back surfaces are directed in a vertical height direction and extend in a width direction of the case body, the rear end edge portion being the second attachment piece, each end edge portion of the cover in a width direction is the first facing portion, and the cover has at its lower portion a flange portion which bends so as to project in a back-and-forth direction of the case body, the flange portion being the second facing portion.

Preferably, the burner case of the present invention further includes a current plate for guiding combustion air, the current plate being a member produced separately from the bottom wall portion, the current plate being provided on an upper side of the bottom wall portion, the current plate having a third attachment piece which is overlapped on the second attachment piece and is interposed together with the second attachment piece between the second facing portion and the second extending portion.

Preferably, the second caulking portion has a concave press portion which is partially pressed in the second direction.

Preferably, the concave press portion is formed on an overlapped portion of the second attachment piece, the second facing portion and the second extending portion.

A burner device proposed in the second aspect of the present invention includes the burner case proposed in the first aspect of the present invention.

The other characteristics and advantages of the present invention are apparent from the following explanation of the preferred embodiments referring to the attached drawings.

DETAILED DESCRIPTION OF THE PREFERRED EMBODIMENT

Preferred embodiments of the present invention are explained below with reference to the accompanying drawings.

Figure 1:
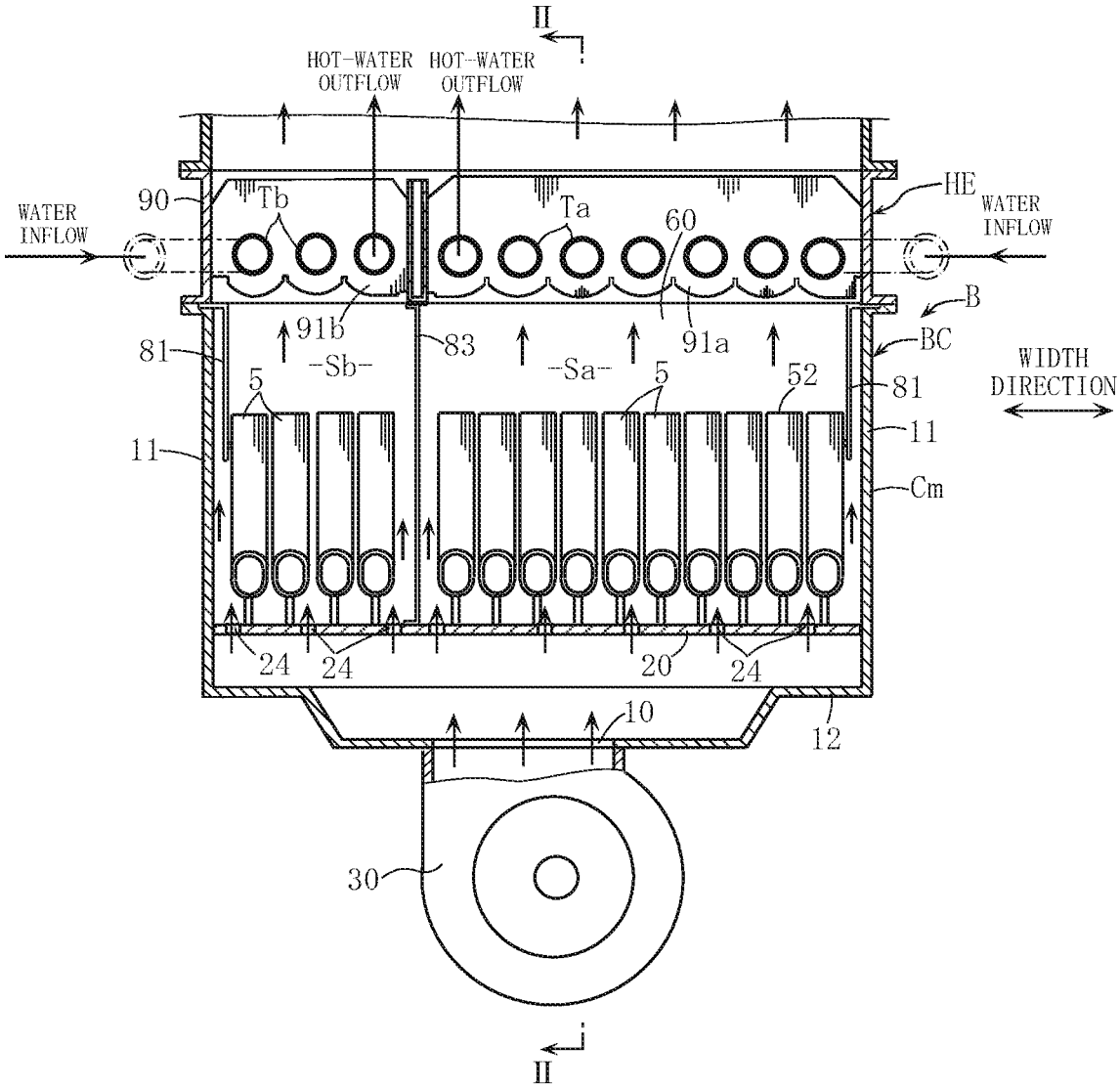
FIG. 1 is a front sectional view showing one embodiment of a water heating apparatus constituted with a burner device of the present invention.
Figure 2:
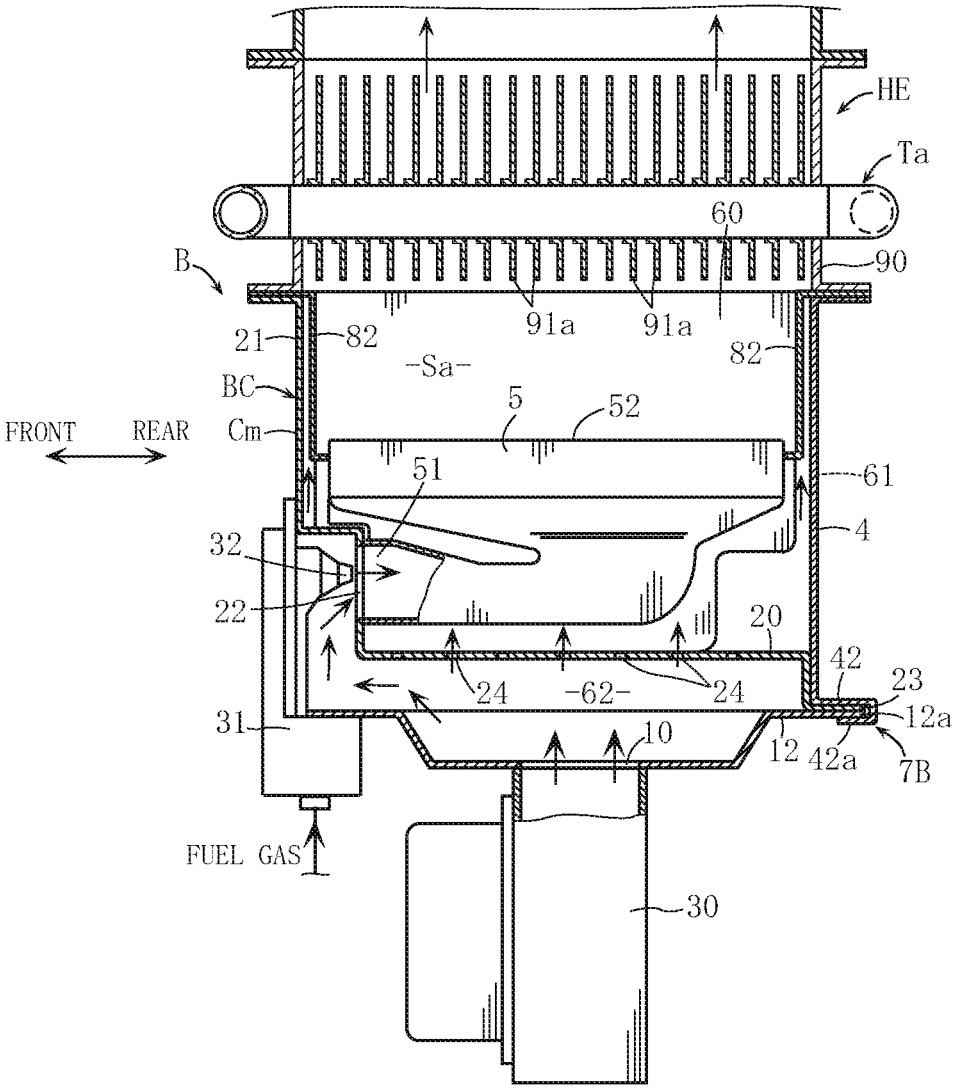
FIG. 2 is a sectional view taken along the line II to II in FIG. 1.

A burner device B shown in FIG. 1 and FIG. 2 is used for heating water in a water heating apparatus. More specifically, the burner device B is used for heating water which flows in heat transfer tubes Ta, Tb of a heat exchanger HE. The heat transfer tubes Ta, Tb, in a meandering shape as seen in plain view, penetrate through a plurality of plate-like fins 91*a*, 91*b* provided in a drum body 90. Water for a general hot-water supply system flows in the heat transfer tube Ta and water for a reheating system for bath or for a hot-water heating system flows in the heat transfer tube Tb.

The burner device B is a gas burner device and has a burner case BC, a plurality of burner bodies 5 housed in the burner case BC, and a fan 30 which is provided under the burner case BC and supplies combustion air into the burner case BC. The burner case BC houses a pair of first side plates 81, a partition plate 83, and a pair of second side plates 82 shown in FIG. 1 and FIG. 2, in addition to the burner bodies 5. The first and the second side plates 81, 82 make positioning of the burner bodies 5 and prevent surrounding walls of the burner case BC from being heated to a high temperature. The partition plate 83 divides the inside of the burner case BC into two combustion areas Sa, Sb.

For example, the burner body 5 can be a conventional one disclosed in Patent Literature 1. The burner bodies 5 are configured to be flat as a whole, at least one fuel gas inlet 51 is provided under their one ends in a longitudinal direction, and a flame hole face 52 on which fuel gas burns is provided on their upper faces.

Figure 3A:
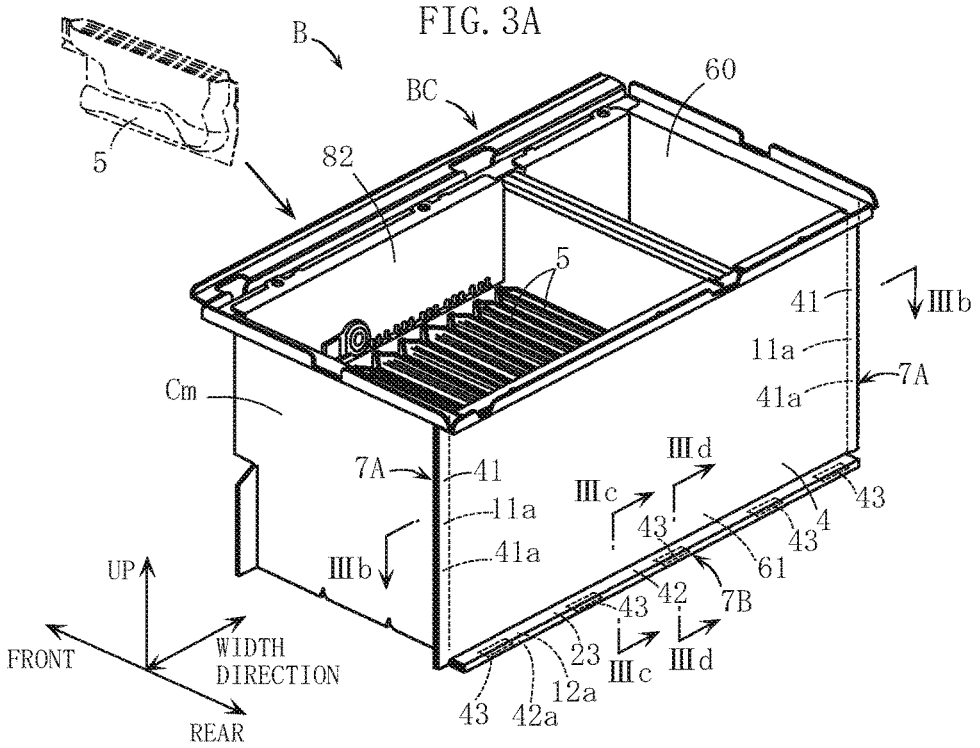
FIG. 3A is a perspective view of an essential part of the burner device shown in FIG. 1 and FIG. 2.
Figure 4:
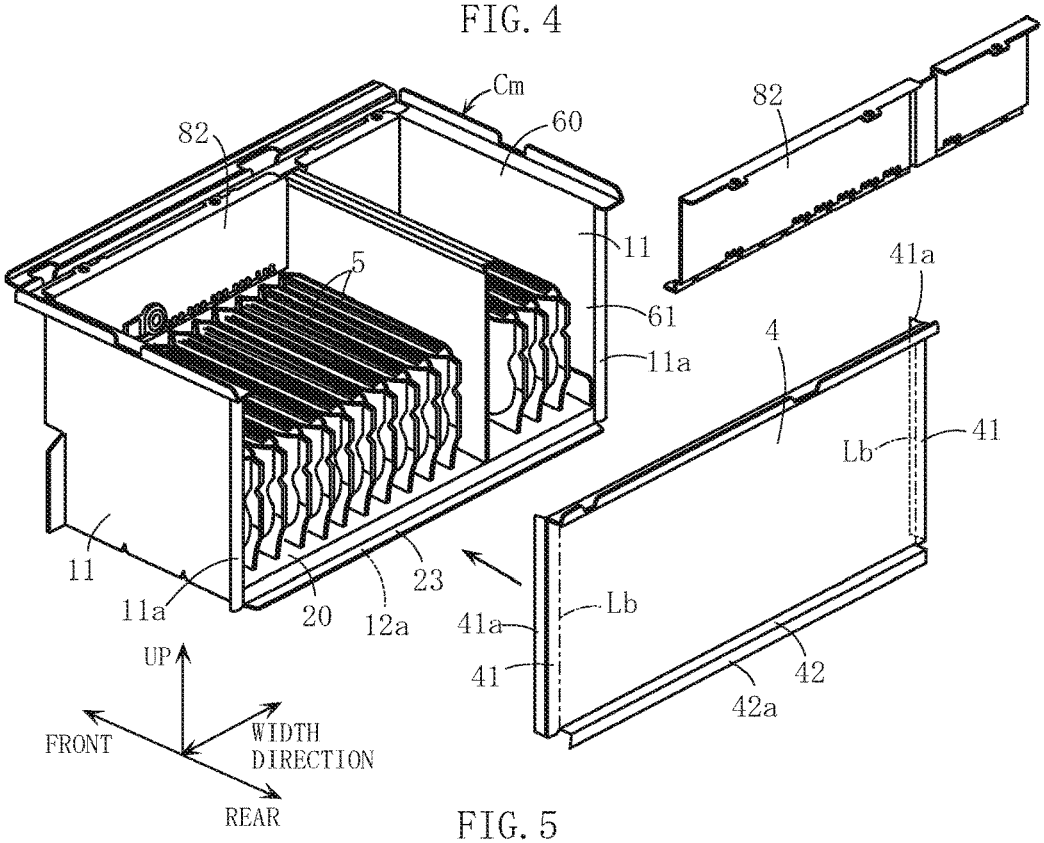
FIG. 4 is an exploded perspective view of FIG. 3A and shows a case body and a cover of the burner case.

As shown in FIG. 3A, the burner case BC is in a shape of a substantial cuboid having an upper opening 60 and is constituted with a case body Cm and a cover 4. As shown in FIG. 4, the case body Cm has a rear opening 61 in addition to the above-mentioned upper opening 60, namely has two openings. The upper opening 60 is for supplying combustion gas generated in the burner body 5 upward. The rear opening 61 is for operations such as assembly of the burner body 5 into the case body Cm and is closed by the cover 4. The rear opening 61 is one embodiment of the opening of the present invention.

Figure 5:
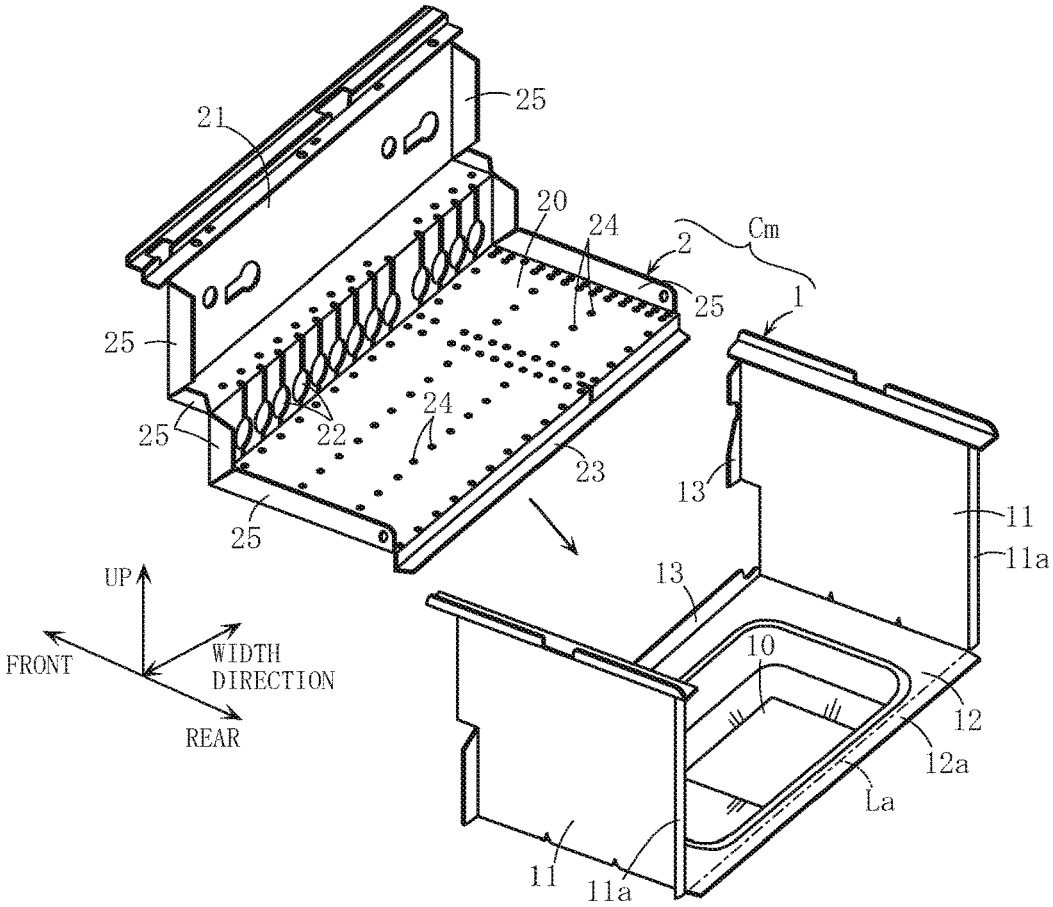
FIG. 5 is an exploded perspective view of the case body shown in FIG. 4.

As shown in FIG. 5, the case body Cm is constituted with a first member 1 and a second member 2 which are produced by pressing a metal plate. The case body Cm of the present invention is able to be constituted with a single member. The first member 1 has a bottom wall portion 12 and a pair of side wall portions 11 which rise upward from or around both end portions of the bottom wall portion 12 in a width direction. The bottom wall portion 12 has a hole 10 for passing through combustion air discharged from the fan 30. The second member 2 has a current plate 20 and a front wall portion 21 which rises upward from a front edge portion of the current plate 20. The case body Cm is assembled in such a manner that the current plate 20 is arranged to be overlapped on the bottom wall portion 12 and the front wall portion 21 is interposed between the side wall portions 11. The first and the second members 1, 2 are assembled in such a manner that the first and the second members 1, 2 are positioned using flange portions 13, 25 respectively provided for the first and the second members 1, 2, and are fastened by TOX caulking or welding. As described below, one end edge portion of the current plate 20 constitutes a third attachment piece 23 and is caulked by a second caulking portion 7B.

As shown in FIG. 2, the front wall portion 21 connected with the current plate 20 has a hole 22 facing the fuel gas inlet 51 of the burner body 5. A flow path 62 for introducing combustion air (primary air) discharged from the fan 30 into the hole 22 and into the fuel gas inlet 51 is provided between the current plate 20 and the bottom wall portion 12. A header 31 for supplying fuel gas is attached in front of the burner case BC. Fuel gas is injected to the hole 22 and the combustion gas inlet 51 from a nozzle 32 of the header 31, and mixed gas of fuel gas and combustion air burns on the flame hole face 52. The current plate 20 has a plurality of vent holes 24 and a part of air (secondary air) discharged from the fan 30 passes through the vent holes 24 to be supplied to an area where the burner bodies 5 are provided.

As shown in FIG. 3A to FIG. 3D, a pair of first caulking portions 7A and a second caulking portion 7B are provided for attaching the cover 4 to the case body Cm. The first and the second caulking portions 7A, 7B and the relating structures are explained below, also referring to FIG. 4.

The case body Cm has a pair of first attachment pieces 11*a*, and a second and a third attachment pieces 12*a*, 23. The first attachment piece 11*a* is an outward projecting flange portion connected with a rear end edge portion of the side wall portion 11, and the front and the back surfaces are directed in the back-and-forth direction of the case body Cm and extend in a pair in the vertical height direction with the width being substantially constant. The second attachment piece 12*a* is a rear end edge portion of the bottom wall portion 12, the rear end edge portion projecting backward further than the side wall portions 11, the rear end edge portion being a tip end side portion of the bottom wall portion 12 further than an imaginary line La extending in the width direction in FIG. 5. The front and the back surfaces of the second attachment piece 12*a* are directed in the vertical height direction and extend in the width direction of the case body Cm with the back-and-forth width being substantially constant. The third attachment piece 23 is a rear end edge portion of the current plate 20 and is overlapped on the second attachment piece 12*a*. The third attachment piece 23 extends in the width direction of the case body Cm with the back-and-forth width being substantially constant.

On the other hand, the cover 4 is in a shape of a plate which rises in the vertical height direction. The cover 4 has a pair of first facing portions 41 facing the first attachment pieces 11*a*, and a second facing portion 42 facing the second and the third attachment pieces 12*a*, 23. The first facing portions 41 are both end edge portions of the cover 4 in the width direction, the end edge portions being tip side portions in the width direction further than an imaginary lines Lb extending in the vertical direction in FIG. 4. The first facing portion 41 is connected with the first extending portion 41*a* for caulking. The second facing portion 42 is a flange portion which bends so as to project into a rear side of the cover 4 from a lower portion of the cover 4. The second facing portion 42 is connected with the second extending portion 42*a* for caulking.

Figure 3B:
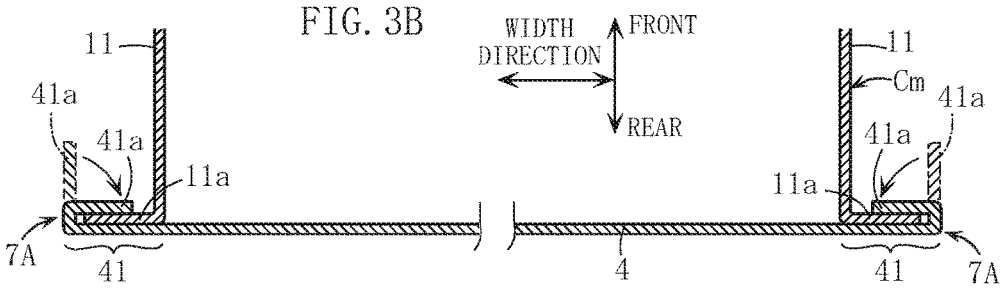
FIG. 3B is a sectional view taken along the line IIIb to IIIb in FIG. 3A.

As shown in FIG. 3B, in the first calking portion 7A, the first attachment piece 11*a* and the first facing portion 41 face and contact with each other in the back-and-forth direction of the case body Cm (one example of the first direction in the present invention) and the first extending portion 41*a* is bent so as to cover the back side, i.e. the forward side, of the first attachment piece 11*a*. Thus, the first attachment piece 11*a* is firmly interposed between the first extending portion 41*a* and the first facing portion 41. The first facing portion 41 is one example of a first extending base portion in the present invention and the first attachment piece 11*a* is one example of a first non-extending base portion in the present invention.

Figure 3C:
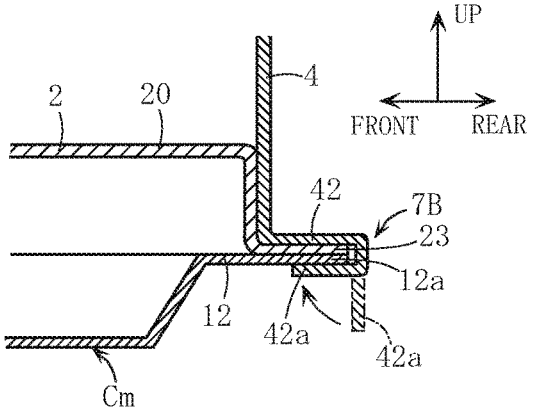
FIG. 3C is a sectional view taken along the line IIIc to IIIc in FIG. 3A.

As shown in FIG. 3C, in the second caulking portion 7B, the second and the third attachment pieces 12*a*, 23 and the second facing portions 42 face each other and are overlapped in the vertical height direction (one example of the second direction in the present invention), and the second extending portion 42*a* is bent so as to cover the back side, i.e. the lower side, of the second attachment piece 12*a*. Thus, the second and the third attachment pieces 12*a*, 23 are firmly interposed between the second extending portion 42*a* and the second facing portion 42. The second facing portion 42 is one example of a second extending base portion in the present invention and the second attachment piece 12*a* is one example of a second non-extending base portion in the present invention.

Figure 3D:
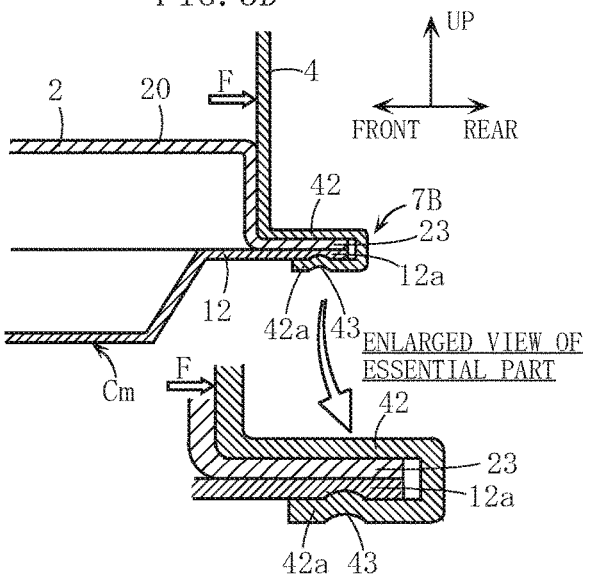
FIG. 3D is a sectional view taken along the line IIId to IIId in FIG. 3A.
Figure 6:
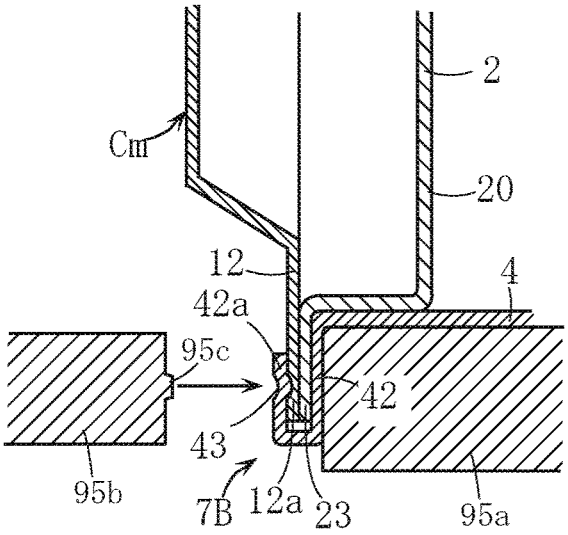
FIG. 6 is a sectional view of an essential part showing one embodiment of an operation process for producing a concave press portion shown in FIG. 3D.

As shown in FIG. 3D, the second caulking portion 7B includes a concave press portion 43 which is formed by being partially pressed in the vertical height direction, i.e. the second direction. Preferably, the concave press portion 43 is provided for the second extending portion 42*a* so as to recess into the second attachment piece 12*a*. As shown in FIG. 3A, a plurality of concave press portions 43 are preferably provided at appropriate intervals in the longitudinal direction, i.e. the width direction, of the second caulking portion 7B. Instead, the concave press portion 43 can be configured to extend linearly in the longitudinal direction of the second caulking portion 7B. As shown in FIG. 6, the concave press portion 43 is produced by being pressed while the second caulking portion 7B is interposed between a pair of molds 95*a*, 95*b*. The mold 95*b* has a convex portion 95*c* for forming the concave press portion 43.

Next, the operation of the burner device B is explained.

The cover 4 of the burner case BC is attached to the case body Cm by the first and the second caulking portions 7A, 7B without using a screw means. Therefore, a fastening member such as a screw is not required and the production cost is reduced.

As shown in FIG. 3B, in the first caulking portion 7A, the first attachment portion 11*a* and the first facing portion 41 tightly contact with each other and the air tight sealing ability is high, so that a sealing packing is not required to be interposed therebetween. In the similar manner, as shown in FIG. 3C, in the second caulking portion 7B, the second and the third attachment pieces 12*a*, 23 and the second facing portion 42 are tightly overlapped, so that a sealing packing is not required to be interposed therebetween. Therefore, the production cost is further reduced by eliminating the sealing packing. The number of processes for providing the first and the second caulking portions 7A, 7B is reduced comparing to that for screwing plural parts, thereby reducing the operation hours. The current plate 20 is fixed to the bottom wall portion 12 of the case body Cm by the second caulking portion 7B. The current plate 20 is not required to be screwed for being fixed to the bottom wall portion 12 or the number of screws is reduced. Therefore, the production cost of the burner case BC is reduced.

The caulking direction of the first caulking portion 7A is in the back-and-forth direction of the case body Cm. On the other hand, the caulking direction of the second caulking portion 7B is in the vertical height direction. The caulking directions of the first and the second caulking portions 7A, 7B cross each other. Therefore, when the first facing portion 41 of the cover 4 abuts the first attachment piece 11*a* of the case body Cm for constituting the first caulking portion 7A, the cover 4 has flexibility so as to be slidably arranged in the vertical direction and the horizontal direction while keeping abutting. By such a flexibility, the second facing portion 42 is suitably overlapped on the second and the third attachment pieces 12*a*, 23, thereby enabling caulking utilizing the second extending portion 42*a*. Thus, even when the dimension accuracy of the members of the case body Cm and the cover 4 is not so high, the first and the second caulking portions 7A, 7B are kept in a highly airtight condition. Contrary to the embodiment of the present invention, when the case body Cm and the cover 4 face and contact with each other and are caulked in one direction at plural points, they are not appropriately caulked and fastened in case that the members thereof have distortion or misalignment. In the embodiment of the present invention, such a disadvantage is appropriately solved. Therefore, the embodiment is more preferable for improving the productivity of the burner case BC.

As shown in FIG. 3D, the concave press portion 43 is partially provided for the second extending portion 42*a* and strongly contacts the second attachment piece 12*a* under pressure. By such a compression contact structure, a part of the second attachment piece 12*a* is recessed corresponding to the concave press portion 43 and it is possible that the concave press portion 43 is engaged with the recessed portion. By such a structure, in the second caulking portion 7B, the second facing portion 42 and the second extending portion 42*a* are firmly fixed to the second and the third attachment pieces 12*a*, 23 so as not to cause misalignment in the back-and-forth direction. As a result, even when a force "F" shown in FIG. 3D is applied to the cover 4, the cover 4 is appropriately prevented from being easily removed in the same direction of the force "F" from the case body Cm. Such a structure enhances the mechanical strength of the burner case BC and the cover 4 is hardly removed from the case body Cm even when the burner case BC is dropped by mistake during transportation.

The concave press portion 43 is preferably provided for the second extending portion 42*a*; however, it can be provided for the second facing portion 42.

Figure 7A:
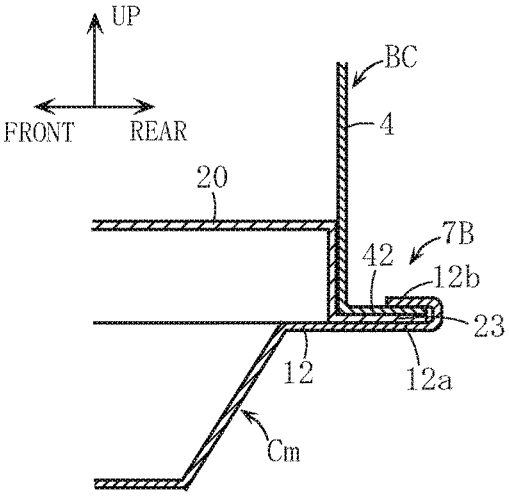
FIG. 7A to FIG. 7C are sectional views of essential parts showing other embodiments of the present invention.
Figure 7B:
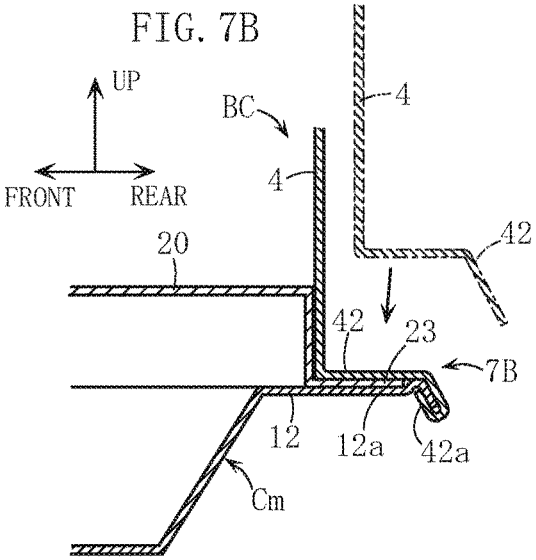
Figure 7C:
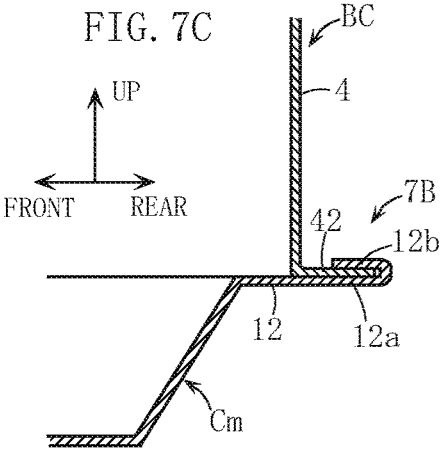

FIG. 7A to FIG. 7C show other embodiments of the present invention. In the figures, the same or the similar elements in the above mentioned embodiments are allotted with the same reference numerals and redundant explanations are omitted.

In an embodiment shown in FIG. 7A, a second extending portion 12*b* is connected to the second attachment piece 12*a* of the case body Cm. The second caulking portion 7B is configured in such a manner that the third attachment piece 23 and the second facing portion 42 of the cover 4 are interposed between the second extending portion 12*b* and the second attachment piece 12*a*. In such a configuration, the bottom wall portion 12, the current plate 20 and the cover 4 are appropriately fastened by caulking. As shown in this embodiment, the extending portion, i.e. the first and the second extending portions, of the present invention can be provided for either the cover 4 or the case body Cm.

In an embodiment shown in FIG. 7B, a portion close to a tip end of the second attachment piece 12*a* of the case body Cm bends in a downward inclined manner, and a part of the second facing portion 42 and the second extending portion 42*a* of the cover 4 are correspondingly bent. In this embodiment, as shown with an imaginary line in the figure, the second facing portion 42 of the cover 4 is arranged to bend in a downward inclined manner in advance. Therefore, when the cover 4 comes close to the case body Cm, the downward inclined portion of the second facing portion 42 and that of the second attachment piece 12*a* contact with each other, thereby the downward inclined portions are smoothly positioned.

In the embodiment shown in FIG. 7C, the second caulking portion 7B does not include the third attachment piece 23 of the current plate 20. Other structures are the same as those of the second caulking portion 7B in FIG. 7A. The present invention does not relate to the attachment structure of the current plate 20 as a direct technical object and several ways for attaching the current plate 20 are adoptable.

The present invention is not limited to the above-mentioned preferred embodiments. The concrete configuration of the members of the burner case and the burner device of the present invention is freely designed within the intended scope of the present invention.

In the above-mentioned embodiments, a pair of side wall portions 11 of the case body Cm have the flange portions of which front and back surfaces are directed in the back-and-forth direction of the case body Cm, the flange portion constituting the first attachment piece 11*a*, the rear end edge portion of the bottom wall portion 12 of the case body Cm constituting the second attachment piece 12*a*. However, the present invention is not limited to such a structure. Contrary to such a structure, the flange portion of which front and back surfaces are directed in the back-and-forth direction of the case body Cm can be provided for the bottom wall portion 12 of the case body Cm and can constitute the second attachment piece, and the rear end edge portions of the side wall portions 11 of the case body Cm can constitute a pair of first attachment pieces. In this case, the first and the second facing portions of the cover 4 are provided so as to face the first and the second attachment pieces.

The opening of the case body which is closed by the cover is not limited to the above-mentioned rear opening, and the specific position and size are not limited. The rear opening of the case body in the present invention is not limited to the opening which faces the back of the burner device when the burner device is installed. The rear face of the case body in the present invention refers to a face provided with an opening for assembling the burner body into the case body.

In the present invention, the cover is able to be fastened by caulking to the case body even if the objective caulking portions of the case body and the cover have a little dimensional error. Such an effect is achieved based on the relation such that the caulking directions of the first and the second caulking portions intersect with each other. Therefore, the caulking directions of the first and the second caulking portions, i.e. the first direction and the second direction in the present invention, are not limited to the back-and-forth direction and the vertical height direction.

The burner device of the present invention is not limited to be used for a water heating apparatus and is able to be used for several purposes such as a fan heater and incineration equipment. The specific configuration of the burner body is not limited.

The invention claimed is:

1. A burner case, comprising:

a case body having an opening and housing a burner body;

a cover configured to be attached to the case body and to close the opening;

a first attachment piece and a second attachment piece which are provided for the case body along a periphery of the opening;

a first facing portion provided for the cover and configured to face the first attachment piece in a predetermined first direction, a second facing portion provided for the cover and configured to face the second attachment piece in a second direction intersecting with the first direction, a first caulking portion configured in such a manner that a first non-extending base portion is interposed between a first extending portion and a first extending base portion in the first direction, the first extending base portion being one of the first attachment piece or the first facing portion, the first extending base portion being connected with the first extending portion with an angle, the other of the first attachment piece and the first facing portion being the first non-extending base portion; and a second caulking portion configured in such a manner that a second non-extending base portion is interposed between a second extending portion and a second extending base portion in the second direction, the second extending base portion being one of the second attachment piece or the second facing portion, the second extending base portion being connected with the second extending portion with an angle, the other of the second attachment piece and the second facing portion being the second non-extending base portion.

2. The burner case as set forth in claim 1, wherein the case body and the cover are respectively made of a metal plate.

3. The burner case as set forth in claim 1, wherein either the first direction or the second direction is an opening direction of the opening.

4. The burner case as set forth in claim 1, wherein the case body has a bottom wall portion, a pair of side wall portions provided on right and left, and a rear opening, the side wall portions rising upward from both end portions of the bottom wall portion in a width direction, the rear opening being surrounded with rear end edge portions of the side wall portions and a rear end edge portion of the bottom wall portion, the rear opening constituting the opening, the first and the second attachment pieces are provided for the rear end edge portions of the side wall portions and the rear end edge portion of the bottom wall portion, and the cover is in a shape of a plate rising in a vertical height direction, the first facing portion is provided at both end portions of the cover in a width direction, and the second facing portion is provided at a lower end portion of the cover.

5. The burner case as set forth in claim 4, wherein each rear end edge portion of the side wall portions is provided with a flange portion of which front and back surfaces are directed in a back-and-forth direction of the case body and extend in a vertical height direction, the flange portion being the first attachment piece, the rear end edge portion of the bottom wall portion is configured in such a manner that the front and the back surfaces are directed in a vertical height direction and extend in a width direction of the case body, the rear end edge portion of the bottom wall portion being the second attachment piece, each end edge portion of the cover in a width direction is the first facing portion, and the cover has at its lower portion a flange portion which bends so as to project in a back-and-forth direction of the case body, the flange portion being the second facing portion.

6. The burner case as set forth in claim 4, further comprising a current plate for guiding combustion air, the current plate being a member produced separately from the bottom wall portion, the current plate being provided on an upper side of the bottom wall portion, the current plate having a third attachment piece which is overlapped on the second attachment piece and is interposed together with the second attachment piece between the second facing portion and the second extending portion.

7. The burner case as set forth in claim 1, wherein the second caulking portion has a concave press portion which is partially pressed in the second direction.

8. The burner case as set forth in claim 7, wherein the concave press portion is formed on an overlapped portion of the second attachment piece, the second facing portion and the second extending portion.

9. A burner device comprising the burner case as set forth in claim 1.

* * * * *